US011384501B2

(12) United States Patent
Li et al.

(10) Patent No.: US 11,384,501 B2
(45) Date of Patent: Jul. 12, 2022

(54) METHOD FOR SEALING POST-CAST STRIP IN FOUNDATION WITH NO GAP

(71) Applicant: Qingdao Tianyuan Weiye Thermal Insulation and Waterproof Engineering Co., Ltd., Shandong (CN)

(72) Inventors: Junwei Li, Shandong (CN); Qiang Li, Shandong (CN)

(73) Assignee: Qingdao Tianyuan Weiye Thermal Insulation and Waterproof Engineering Co., Ltd., Shandon (CN)

( * ) Notice: Subject to any disclaimer, the term of this patent is extended or adjusted under 35 U.S.C. 154(b) by 0 days.

(21) Appl. No.: 17/145,238

(22) Filed: Jan. 8, 2021

(65) Prior Publication Data

US 2021/0348354 A1 Nov. 11, 2021

(30) Foreign Application Priority Data

May 6, 2020 (CN) ..... 202010371567.5

(51) Int. Cl.
*E02D 29/16* (2006.01)
*E02D 15/02* (2006.01)

(52) U.S. Cl.
CPC ..... *E02D 15/02* (2013.01); *E02D 29/16* (2013.01); *E02D 2250/003* (2013.01); *E02D 2300/002* (2013.01); *E02D 2300/0032* (2013.01); *E02D 2300/0034* (2013.01)

(58) Field of Classification Search
CPC ..... E02D 27/00; E02D 29/16; E02D 15/02
USPC ..... 405/269, 279
See application file for complete search history.

(56) References Cited

U.S. PATENT DOCUMENTS 2,196,211 A * 4/1940 Hartman ..... E02F 5/12 405/269

FOREIGN PATENT DOCUMENTS

| | | | |
|---|---|---|---|
| CN | 101131000 A | | 2/2008 |
| CN | 103628494 A | | 3/2014 |
| CN | 102650128 B | * | 6/2014 |
| CN | 106759522 A | * | 5/2017 |
| CN | 108166532 A | * | 6/2018 |
| CN | 108316329 A | * | 7/2018 |

* cited by examiner

*Primary Examiner* — Frederick L Lagman
(74) *Attorney, Agent, or Firm* — Dickinson Wright PLLC; Donald McPhail

(57) ABSTRACT

A method for sealing a post-cast strip in a foundation with no gap includes the following steps: mounting steel plates, horizontal pipes and vertical pipes cooperatively layer by layer in a post-cast strip, respectively, such that the upper open end of each vertical pipe protrudes from the ground through the post-cast strip; pouring grout into the post-cast strip from the top of the post-cast strip after the end of the settlement of the foundation, and carrying out high-pressure grouting into the vertical pipe using grouting equipment simultaneously; delivering the sealing grout poured into the vertical pipe to the horizontal pipes, such that the sealing grout overflows from the grout outlets of the horizontal pipes to densely fill up existing gaps; and cutting off the portion of the vertical pipe above the ground after the post-cast strip is completely sealed, and levelling the top of the cut-off vertical pipe with concrete.

2 Claims, 2 Drawing Sheets

METHOD FOR SEALING POST-CAST STRIP IN FOUNDATION WITH NO GAP

TECHNICAL FIELD

The present disclosure belongs to the technical field of foundation construction of building works, relates to a process of sealing a post-cast strip between foundations of building works, and in particular, to a method for sealing a post-cast strip in a foundation with no gap.

BACKGROUND

A post-cast strip is a concrete strip which is a leave-out with a particular width in a structure such as a beam, a slab (including a foundation slab) and a wall and cast after a particular period of time so as to adapt to the effects of such factors as environment temperature change, concrete shrinkage and differential structural settlement. During the building construction, it is desirable to leave out post-cast strips, namely concrete strips, in corresponding positions of foundation slabs, walls and beams according to design or construction code requirements for the purpose of preventing formation of possible harmful cracks in a cast-in-place reinforced concrete structure due to differential shrinkage or differential settlement thereof. A structure may be temporarily divided into several sections by post-cast strips, and the construction joints may be cast with concrete after internal shrinkage of members over a period of time to integrally join the structure again. A low air temperature may be better for casting of a post-cast strip, and concrete with cement or cement mixed with a tiny amount of aluminum powder, which is required to have a higher strength grade than members, can be used for casting, preventing formation of weak areas resulting from cracks between fresh concrete and old concrete.

In the prior art, Chinese patent No. CN101131000 discloses a construction method for controlling differential settlement of a building, which includes the following steps: (1) forming settlement joints; (2) enhancing the overall stiffness of the bearing structure; and (3) treating the foundation. This invention has the following advantages: 1, a reasonable settlement joint is one of effective measures for reducing damage of differential foundation deformation to a building; and 2, the dead load of superstructure and base accounts for about 40% to 70% of total load. This portion may be larger, about 60% to 70%, with respect to a civil building. Therefore, foundation treatment and reduction of dead load of a structure are effective measures for reducing building settlement. Chinese patent application No. CN103628494A discloses a method for treating the base of a foundation, including using furnace slag, medium sand, coarse sand, soil-rock or cohesive soil material in a soil-rock composite foundation, with a cushion having a thickness of 300-500 mm. With regard to a soil-rock composite foundation differing sharply in soil thickness, especially a position having a great difference in foundation compression amount, a settlement joint is required to have an enough width. The settlement joint may be 50-80 mm for a building with 2 to 3 floors, 80-120 mm wide for a building with 4 to 5 floors, and not less than 120 mm for a building with 5 or more floors. A post-cast strip is to be disposed at the joint of upper and lower floors with a width of not less than 500 mm. Thus, the problems in functions of use and water proofing of a building.

To prevent such problems as water leakage and unstable foundation of a building due to water storage in a post-cast strip between foundations, as shown in FIG. 1, during the construction of the foundation, equally spaced steel plates 2 are disposed on the side, where the post-cast strip is located, of the foundation 1, and the steel plates 2 between two adjacent foundations 1 are connected by steel bars 9. After the end of the settlement of the foundation, concrete or other sealing grout 5 is poured into the post-cast strip to securely join the two foundations while preventing the problem of water-logging in the post-cast strip. However, during filling of the sealing grout 5, gaps 4 are present between the lower sides of the steel plates 2 and the sealing grout 5, leading to non-dense sealing of the post-cast strip. The gaps 4 may have influence on firmness of joining of two foundations 1. Besides, in later use, the problem of water-logging may arise on the gaps 4, thereby resulting in the problem of water leakage in the foundation or underground building.

SUMMARY

An objective of the present disclosure is to overcome the shortcomings in the prior art. In view of disadvantages of water leakage in a basement and unstable connection between foundations easily caused by non-dense sealing of a post-cast strip between foundations in the prior art, the present disclosure aims to design a method for sealing a post-cast strip in a foundation with no gap while guaranteeing environmental protection and energy saving and low cost.

To achieve the above objective, a method for sealing a post-cast strip in a foundation with no gap provided in the present disclosure is implemented in conjunction with a sealing structure of a post-cast strip between two adjacent building foundations. The sealing structure includes a post-cast strip disposed between two adjacent foundations, and equally spaced bridge-like steel plates that are disposed in the foundations on two sides of the post-cast strip, respectively. A grouting pipe is disposed on each side, which is secured to junctions of lower sides of the steel plates and the foundation. The grouting pipe is composed of a vertical pipe and a plurality of horizontal pipes that are interconnected with the vertical pipe. Each horizontal pipe is secured in the corner where the lower side of each steel plate and the foundation are joined together, and a plurality of equally spaced grout outlets are formed in a side surface of the horizontal pipe. Each grout outlet, shaped as a flared opening, is communicated with the inner cavity of the horizontal pipe. The same ends of all the horizontal pipes are fixedly connected to a sidewall of the vertical pipe, and the inner cavities of the horizontal pipes are interconnected with the inner cavity of the vertical pipe to enable smooth flow therethrough. The steel plates in the two adjacent foundations are connected by steel bars. The process of sealing the post-cast strip specifically includes the following steps.

(1) During the construction of a large-scale architectural project such as a storied building or a mall, the integral foundation is divided into several independent foundations and post-cast strips are disposed between adjacent foundations.

(2) Equally spaced steel plates are mounted layer by layer from bottom to top in each of the foundations on two sides of each post-cast strip during the construction. After the first-layer steel plate at the bottom end is mounted, the horizontal pipe having grout outlets in the sidewall thereof is secured to the junction of the lower side of the first-layer steel plate and the foundation. One end of each secured horizontal pipe is communicated with the sidewall of the vertical pipe that is arranged vertically, so that the grouting pipe allowing for smooth flow therethrough is formed.

(3) The steel plates, the horizontal pipes and the vertical pipes are mounted cooperatively layer by layer according to step (2), respectively, such that the upper open end of each vertical pipe protrudes from the ground through the post-cast strip, facilitating grouting by grouting equipment through the upper open end of the vertical pipe.

(4) The steel plates of each layer, and upper and lower adjacent steel plates are fixedly connected by steel bars. A building main body is constructed on each independent foundation. After the completion of the construction of the building main body, the foundation is to undergo settlement, during which the settlement of each foundation occurs in a different degree due to the different environment, and displacement occurs between adjacent foundations.

(5) Concrete or colloidal sealing grout is poured into the post-cast strip from the top of the post-cast strip after the end of the settlement of the foundation, and high-pressure grouting into the vertical pipe using grouting equipment is carried out simultaneously.

(6) The sealing grout poured into the vertical pipe is delivered to the horizontal pipes while the main space of the post-cast strip is sealed by the sealing grout. The sealing grout overflows from the grout outlets of the horizontal pipes to densely fill up existing gaps, so that no-gap sealing of the post-cast strip is achieved.

(7) The portion of the vertical pipe above the ground is cut off after the post-cast strip is completely sealed. The top of the cut-off vertical pipe is levelled with concrete, so that capping of the post-cast strip is completed.

To facilitate pouring of the sealing grout into the horizontal pipes, a through hole is formed in the middle of each steel plate, and the vertical pipe passes through the middle through hole of each steel plate and is communicated with the middle of each horizontal pipe. Alternatively, vertical pipes are disposed at two ends of the horizontal pipes, respectively.

Compared with the prior art, the designed method for sealing a post-cast strip in a foundation with no gap according to the present disclosure is reasonable and complete in process, and scientific and practical, and effectively solves the problem of presence of gaps between lower sides of the steel plates and the sealing grout between foundations. The post-cast strip can be densely sealed, thereby effectively avoiding the problems of water-logging in the post-cast strip, water leakage in basement and unstable connection between foundations. Moreover, the method is low in cost and environmentally friendly in use.

DETAILED DESCRIPTION

The present disclosure will be further described below by way of embodiment with reference to the accompanying drawings.

Embodiment 1

Figure 1:
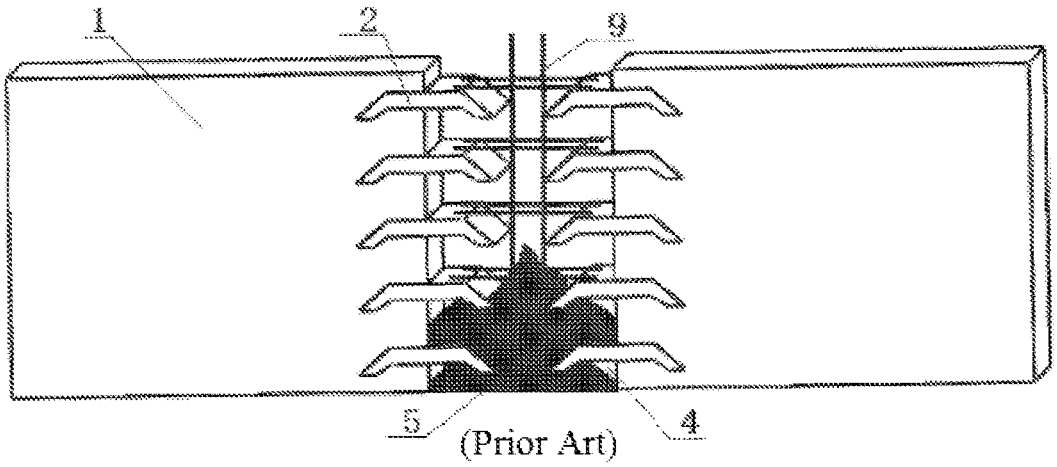
(Prior Art) FIG. 1
FIG. 1 is a schematic diagram illustrating a structure in an existing post-cast strip sealing process according to an embodiment of the present disclosure.
Figure 2:
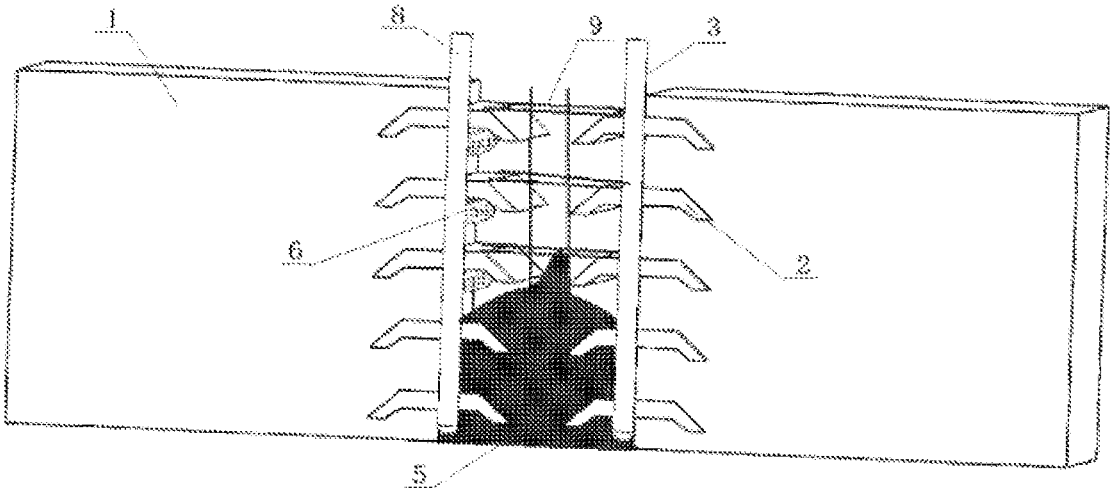
FIG. 2 is a schematic diagram illustrating a structure of a post-cast strip with grouting pipes set up according to an embodiment of the present disclosure.
Figure 3:
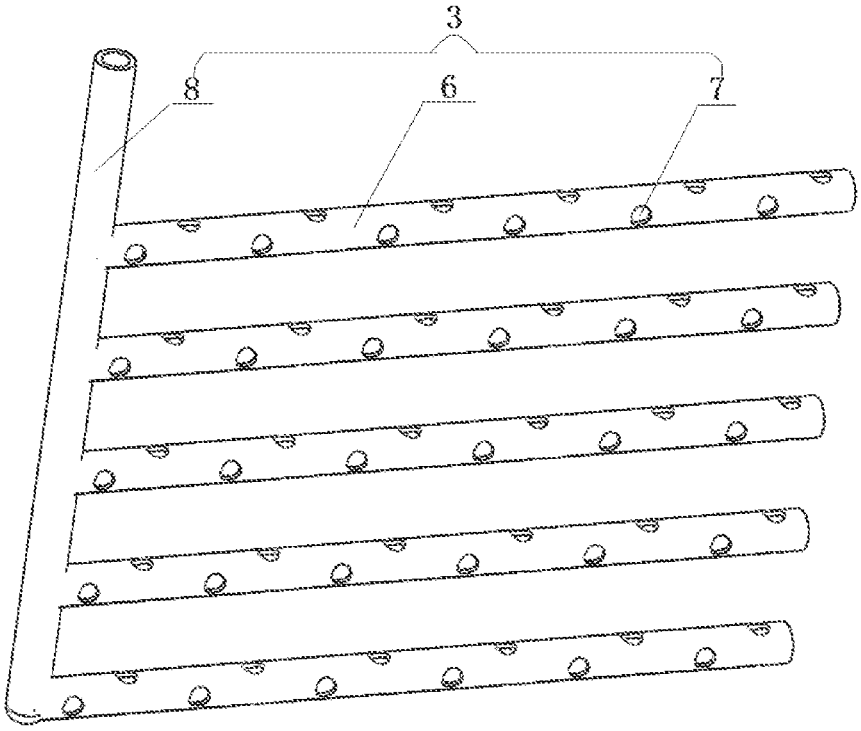
FIG. 3 is a schematic diagram illustrating a structure of a grouting pipe with one vertical pipe according to an embodiment of the present disclosure.

A method for sealing a post-cast strip in a foundation with no gap that this embodiment relates to is implemented in conjunction with a sealing structure of a post-cast strip between two adjacent building foundations. As shown in FIG. 2 and FIG. 3, the sealing structure of the post-cast strip between two adjacent building foundations includes a post-cast strip disposed between two adjacent foundations 1, and equally spaced bridge-like steel plates 2 that are disposed in the foundations 1 on two sides of the post-cast strip, respectively. A grouting pipe 3 is disposed on each side, which is secured to junctions of lower sides of the steel plates 2 and the foundation 1. The grouting pipe 3 is composed of one vertical pipe 8 and a plurality of horizontal pipes 6 that are interconnected with the vertical pipe. Each horizontal pipe 6 is secured in the corner where the lower side of each steel plate 2 and the foundation 1 are joined together, and a plurality of grout outlets 7 are uniformly formed in a side surface of the horizontal pipe 6. Each grout outlet 7, shaped as a flared opening, is communicated with the inner cavity of the horizontal pipe 6. The same ends of all the horizontal pipes 6 are fixedly connected to a sidewall of the vertical pipe 8, and the inner cavities of the horizontal pipes 6 are interconnected with the inner cavity of the vertical pipe 8 to enable smooth flow therethrough. The steel plates 2 in the two adjacent foundations 1 are connected by steel bars 9. The process of sealing the post-cast strip specifically includes the following steps.

(1) During the construction of large-scale building works such as a storied building or a mall, the integral foundation is divided into several independent foundations 1 and post-cast strips are disposed between adjacent foundations 1.

(2) Equally spaced steel plates 2 are mounted layer by layer from bottom to top in each of the foundations 1 on two sides of each post-cast strip during the construction. After the first-layer steel plate 2 at the bottom end is mounted, the horizontal pipe 6 having grout outlets 7 in the sidewall thereof is secured to the junction of the lower side of the first-layer steel plate 2 and the foundation 1. One end of each secured horizontal pipe 6 is communicated with the sidewall of the vertical pipe 8 that is arranged vertically, so that the grouting pipe 3 allowing for smooth flow therethrough is formed.

(3) The steel plates 2, the horizontal pipes 6 and the vertical pipes 8 are mounted cooperatively layer by layer according to step (2), respectively, such that the upper open end of each vertical pipe 8 protrudes from the ground through the post-cast strip, facilitating grouting by grouting equipment through the upper open end of the vertical pipe 8.

(4) The steel plates 2 of each layer, and upper and lower adjacent steel plates 2 are fixedly connected by steel bars 9. A building main body is constructed on each independent foundation 1. After the completion of the construction of the building main body, the foundation 1 is to undergo settlement, during which the settlement of each foundation 1 may occur in a different degree due to the different environment, and displacement may occur between adjacent foundations 1, etc.

(5) Concrete or colloidal sealing grout 5 is poured into the post-cast strip from the top of the post-cast strip after the end of the settlement of the foundation 1, and high-pressure grouting into the vertical pipe 8 using grouting equipment is carried out simultaneously.

(6) The sealing grout 5 poured into the vertical pipe 8 is delivered to the horizontal pipes 6 while the main space of the post-cast strip is sealed by the sealing grout 5. The sealing grout 5 overflows from the grout outlets 7 of the horizontal pipes 6 to densely fill up existing gaps 4, so that no-gap sealing of the post-cast strip is achieved.

(7) The portion of the vertical pipe 8 above the ground is cut off after the post-cast strip is completely sealed. The top of the cut-off vertical pipe 8 is levelled with concrete, so that capping of the post-cast strip is completed.

The whole sealing process that this embodiment relates to is simple to operate and low in cost and effectively solves the problem of presence of gaps 4 in sealing of a post-cast strip in the prior art. The post-cast strip can be densely sealed, allowing for stable connection between the adjacent foundations 1 and ensuring the stability of the entire building. The problem of water seepage in a post-cast strip is solved completely, and the problems of water leakage in an underground structure such as basement and unstable foundation due to water storage in a post-cast strip are avoided. Moreover, this method may have no influence on functioning of the post-cast strip and the use of the entire building.

Embodiment 2

A method for sealing a post-cast strip in a foundation with no gap that this embodiment relates to is implemented in conjunction with the sealing structure of the post-cast strip as described in embodiment 1. The process of sealing the post-cast strip specifically includes the following steps.

(1) During the construction of large-scale building works such as a storied building or a mall, the integral foundation is divided into several independent foundations 1 and post-cast strips are disposed between adjacent foundations 1, each post-cast strip having a width of 90-100 cm.

(2) Equally spaced steel plates 2 are mounted layer by layer from bottom to top in each of the foundations 1 on two sides of each post-cast strip during the construction, each steel plate 2 having a length of 80-90 cm and a portion, embedded into the foundation 1, of the steel plate 2 having a length of 40-50 cm. After the first-layer steel plate 2 at the bottom end is mounted, the horizontal pipe 6 having grout outlets 7 in the sidewall thereof is secured to the junction of the lower side of the first-layer steel plate 2 and the foundation 1, the horizontal pipe 6 having an internal diameter of 3-10 cm. One end of each secured horizontal pipe 6 is communicated with the sidewall of the vertical pipe 8 that is arranged vertically, the vertical pipe 8 having an internal diameter of greater than 10 cm.

(3) The steel plates 2, the horizontal pipes 6 and the vertical pipes 8 are mounted cooperatively layer by layer according to step (2), respectively, such that the upper end of each vertical pipe 8 protrudes from the ground through the post-cast strip, with a space between upper and lower adjacent steel plates 2 being 40-60 cm.

(4) The steel plates 2 of each layer, and upper and lower adjacent steel plates 2 are fixedly connected by steel bars 9. A building main body is constructed on each independent foundation 1. After the completion of the construction of the building main body, the foundation 1 is to undergo settlement, which typically lasts for one year and during which the settlement of each foundation 1 may occur in a different degree due to the different environment.

(5) Concrete or colloidal sealing grout 5 is poured into the post-cast strip from the top of the settlement area after the end of the settlement of the foundation 1, and high-pressure grouting into the vertical pipe 8 using grouting equipment is carried out simultaneously.

(6) The sealing grout 5 poured into the vertical pipe 8 is delivered to the horizontal pipes 6 while the main space of the post-cast strip is sealed by the sealing grout 5. The sealing grout 5 overflows from the grout outlets 7 of the horizontal pipes 6 to densely fill up existing gaps 4, so that no-gap sealing of the post-cast strip is achieved.

(7) The portion of the vertical pipe 8 above the ground is cut off after the post-cast strip is completely sealed, and the surface is levelled with concrete, so that capping of the post-cast strip is completed.

In this embodiment, the width of the post-cast strip is determined based on construction experience and terrain, and the height of the foundation 1 is determined based on the height and overall weight of a building, geological conditions, etc. The entire sealing process is complete and convenient in mounting without adding much construction burden. Moreover, the post-cast strip can be densely sealed, allowing for stable connection between the adjacent foundations 1 and ensuring the stability of the entire building. Besides, the problem of water proofing of a post-cast strip is solved completely. The process of sealing the post-cast strip that this embodiment relates to was used in construction of nonuniform geological structures in silt environment at more than 10 places of New Qingdao Airport, and the sealing degree of the post-cast strips was detected to be 100%.

Embodiment 3

This embodiment involves some further improvements on the basis of the sealing structure of the post-cast strip as described in embodiment 1. Specifically, to facilitate pouring of the sealing grout 5 into the horizontal pipes 6, a through hole is formed in the middle of each steel plate 2, and the vertical pipe 8 passes through the middle through hole of each steel plate 2 and is communicated with the middle of each horizontal pipe 6. During high pressure grouting, the sealing grout 5 flows into the middle of each horizontal pipe 6 through the vertical pipe 8 and then is delivered to two ends of the horizontal pipe 6 from the middle of the horizontal pipe 6.

Alternatively, based on the sealing structure of the post-cast strip as described in embodiment 1, vertical pipes 8 are disposed at two ends of the horizontal pipes 6, respectively, in this embodiment. During high pressure grouting, the sealing grout 5 is poured into the vertical pipes 8 communicated with two ends of the horizontal pipes 6 simultaneously by the grouting equipment. The sealing grout 5 flows into two ends of each horizontal pipe 6 through the vertical pipes 8, respectively, and then is delivered to the middle of the horizontal pipe 6 from the two ends of the horizontal pipe 6.

Figure 4:
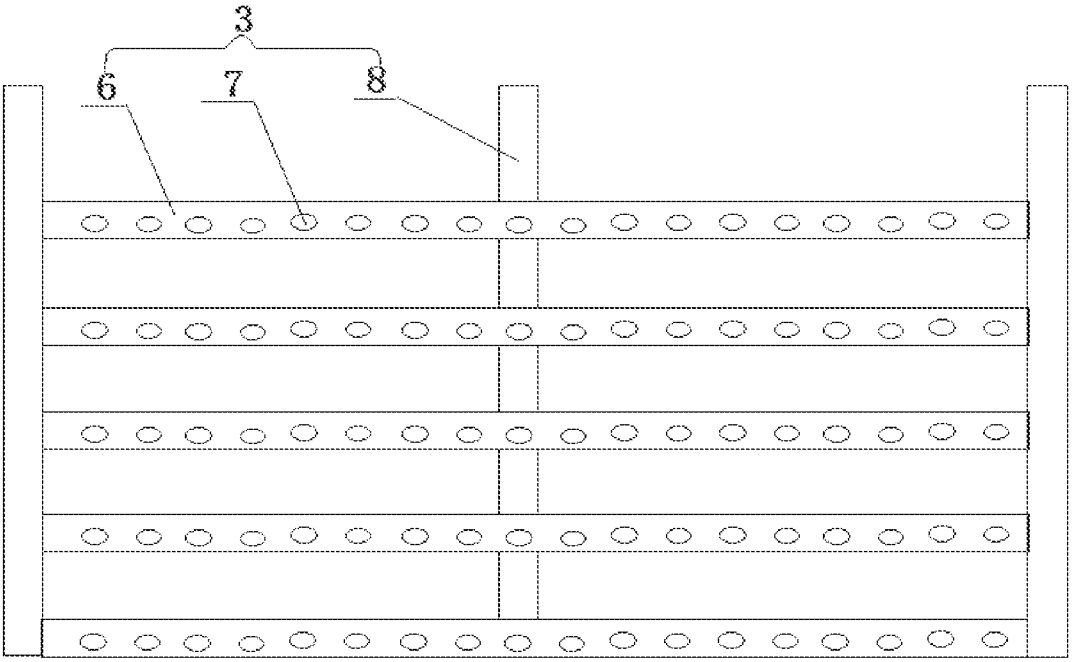
FIG. 4 is a schematic diagram illustrating a structure of a grouting pipe with three vertical pipes according to an embodiment of the present disclosure.

Alternatively, as shown in FIG. 4, based on the sealing structure of the post-cast strip as described in embodiment 1, vertical pipes 8 are disposed at two ends and middles of the horizontal pipes 6, respectively, or equally spaced vertical pipes 8 are disposed on the horizontal pipes 6 based on the construction length of each post-cast strip, in this embodiment. During high pressure grouting, the sealing grout 5 is poured into the vertical pipes 8 communicated with two ends of the horizontal pipes 6 simultaneously by the grouting equipment, thereby ensuring that no gap 4 is present after the post-cast strip is sealed.

In this embodiment, with the structure that the vertical pipe 8 is communicated with the middles of the horizontal pipes 6 or the structure that the vertical pipes 8 are disposed at two ends of the horizontal pipes 6 respectively, the delivery distance of the sealing grout 5 in each horizontal pipes 6 is shortened, so that reduction in energy consumption due to resistance of delivery and environmental protection can be achieved.

What is claimed is:

1. A method for sealing a post-cast strip in a foundation with no gap, the method being implemented in conjunction with a sealing structure of a post-cast strip between two adjacent building foundations, wherein the sealing structure comprises a post-cast strip disposed between two adjacent foundations, and equally spaced bridge-shaped steel plates that are disposed in the foundations on two sides of the post-cast strip, respectively; a grouting pipe is disposed on each side, which is secured to junctions of lower sides of the steel plates and the foundation; the grouting pipe is composed of a vertical pipe and a plurality of horizontal pipes that are interconnected with the vertical pipe; each horizontal pipe is secured in a corner where the lower side of each steel plate and the foundation are joined together, and a plurality of equally spaced grout outlets are formed in a side surface of the horizontal pipe; each grout outlet, shaped as a flared opening, is in fluid communication with an inner cavity of a corresponding one of the horizontal pipes; one end of each horizontal pipe is fixedly connected to a sidewall of the vertical pipe, and the inner cavity of each of the horizontal pipes is interconnected with an inner cavity of the vertical pipe to enable smooth flow therethrough; and the steel plates in the two adjacent foundations are connected by steel bars, specifically comprising the following steps:

(1) during the construction of large-scale building works, dividing an integral foundation into several independent foundations and disposing post-cast strips between adjacent foundations;

(2) mounting a plurality of equally spaced steel plates layer by layer from bottom to top in each of the foundations on two sides of each post-cast strip during the construction, and after a first-layer steel plate at the bottom end is mounted, securing the horizontal pipe having grout outlets in the sidewall thereof to the junction of the lower side of the first-layer steel plate and each foundation, wherein one end of each secured horizontal pipe is in communication with the sidewall of the vertical pipe that is arranged vertically, so that the grouting pipe allowing for smooth flow therethrough is formed;

(3) mounting the steel plates, the horizontal pipes and the vertical pipes cooperatively layer by layer according to step (2), respectively, such that an upper open end of each vertical pipe protrudes from the ground through the post-cast strip, facilitating grouting by grouting equipment through the upper open end of the vertical pipe;

(4) fixedly connecting the steel plates of each layer, and upper and lower adjacent steel plates by steel bars, and constructing a building main body on each foundation, wherein after the completion of the construction of the building main body, the foundations may undergo settlement, during which the settlement of each foundation occurs in a different degree due to the different environment, and displacement occurs between adjacent foundations;

(5) pouring concrete or colloidal sealing grout into the post-cast strip from top of the post-cast strip settlement of the foundation has ended, and carrying out high-pressure grouting into the vertical pipe using grouting equipment simultaneously;

(6) delivering sealing grout into the vertical pipe to the horizontal pipes while the post-cast strip is sealed by the sealing grout, wherein the sealing grout overflows from the grout outlets of the horizontal pipes to densely fill up existing gaps, so that no-gap sealing of the post-cast strip is achieved; and (7) cutting off any portion of the vertical pipe remaining above the ground after the post-cast strip is completely sealed, and levelling the cut-off vertical pipe with concrete, so that capping of the post-cast strip is completed.

2. The method for sealing a post-cast strip in a foundation with no gap according to claim 1, wherein each steel plate has two ends and a middle and a through hole is formed in the middle, and the vertical pipe passes through the middle through hole of each steel plate and is in communication with the middle of each horizontal pipe; alternatively, vertical pipes are disposed at two ends of the horizontal pipes, respectively.

* * * * *